US008756717B2

(12) United States Patent
Claeys

(10) Patent No.: US 8,756,717 B2
(45) Date of Patent: Jun. 24, 2014

(54) GARMENT WITH HIDDEN INSULATED BEVERAGE HOLDER

(75) Inventor: David Michael Claeys, DeWitt, IA (US)

(73) Assignee: Hoodykoo, LLC, Eden Prairie, MN (US)

( * ) Notice: Subject to any disclaimer, the term of this patent is extended or adjusted under 35 U.S.C. 154(b) by 0 days.

(21) Appl. No.: 13/178,876

(22) Filed: Jul. 8, 2011

(65) Prior Publication Data

US 2012/0005802 A1 Jan. 12, 2012

Related U.S. Application Data

(63) Continuation-in-part of application No. 29/355,667, filed on Feb. 11, 2010, now Pat. No. Des. 627,540.

(60) Provisional application No. 61/363,073, filed on Jul. 9, 2010.

(51) Int. Cl.
*A41D 27/20* (2006.01)

(52) U.S. Cl.
USPC ..... 2/250; 2/94

(58) Field of Classification Search
USPC ..... 2/247–252, 93, 94, 102
See application file for complete search history.

(56) References Cited

U.S. PATENT DOCUMENTS

| | | | | | |
|---|---|---|---|---|---|
| 1,879,341 | A | * | 9/1932 | Lapham | 2/102 |
| D161,540 | S | * | 1/1951 | Russfield | D2/836 |
| 4,293,015 | A | * | 10/1981 | McGough | 220/739 |
| 4,401,245 | A | | 8/1983 | Zills | |
| 4,497,071 | A | * | 2/1985 | Bell | 2/94 |
| 4,540,611 | A | * | 9/1985 | Henderson | 428/12 |
| 4,589,134 | A | * | 5/1986 | Waldron | 381/301 |
| 4,630,319 | A | * | 12/1986 | Mathis | 2/250 |
| 4,651,348 | A | * | 3/1987 | Swanson | 2/93 |
| 4,656,669 | A | * | 4/1987 | Beard | 2/67 |
| 4,825,471 | A | * | 5/1989 | Jennings | 2/94 |
| 4,835,821 | A | * | 6/1989 | Durante | 24/66.1 |
| D304,777 | S | | 11/1989 | Glenn | |
| D324,758 | S | | 3/1992 | Esteves | |
| 5,255,392 | A | * | 10/1993 | Stanislaw | 2/247 |
| 5,381,922 | A | * | 1/1995 | Gladman et al. | 220/481 |
| D368,353 | S | | 4/1996 | McCrudden | |
| 5,642,526 | A | * | 7/1997 | Thompson | 2/79 |
| 5,794,263 | A | * | 8/1998 | Carman | 2/84 |
| D410,317 | S | | 6/1999 | Alexander | |
| 6,059,140 | A | | 5/2000 | Hicks | |

(Continued)

FOREIGN PATENT DOCUMENTS

| | | | |
|---|---|---|---|
| DE | 202005018718 | U1 | 3/2006 |
| DE | 202008001210 | U1 | 6/2008 |
| JP | 2002-30511 | A | 1/2002 |

OTHER PUBLICATIONS

"Beer Pouch Sweatsuit with Hood", http://www.vat19.com/dvds/beer-pouch-sw eatshirt-hoodie.cfm, Jan. 22, 2009 (dated by Internet Archive WayBack Machine of www.archive.org).*

*Primary Examiner* — Danny Worrell
(74) *Attorney, Agent, or Firm* — Thomas J. Oppold; Larkin Hoffman Daly & Lindgren Ltd.

(57) ABSTRACT

A beverage holding garment wherein the beverage holder is disposed in the garment such that it is substantially concealed when not in use so that the garment appears to not have a beverage holder.

2 Claims, 8 Drawing Sheets

(56) References Cited

U.S. PATENT DOCUMENTS

| | | | | |
|---|---|---|---|---|
| D439,029 | S | 3/2001 | Goldman | |
| 6,328,146 | B1 | 12/2001 | Siwak | |
| 6,477,710 | B1 * | 11/2002 | Ojoyeyi | 2/69 |
| 6,626,733 | B1 | 9/2003 | Knutson | |
| 6,760,922 | B1 * | 7/2004 | Morales | 2/94 |
| 6,793,051 | B2 | 9/2004 | Siwak | |
| 6,848,118 | B2 * | 2/2005 | Barnes et al. | 2/108 |
| 6,859,943 | B1 * | 3/2005 | Wallace, III | 2/228 |
| 6,976,273 | B1 * | 12/2005 | Lewis et al. | 2/94 |
| 7,137,493 | B2 | 11/2006 | Siwak | |
| D535,456 | S | 1/2007 | Anderson | |
| 7,171,695 | B2 * | 2/2007 | Braun | 2/93 |
| 7,364,491 | B2 * | 4/2008 | Updyke | 450/89 |
| D570,577 | S * | 6/2008 | Keppler | D2/750 |
| D600,887 | S * | 9/2009 | Williams et al. | D2/839 |
| D608,983 | S * | 2/2010 | Myers | D2/857 |
| D627,540 | S * | 11/2010 | Claeys | D2/750 |
| 8,312,568 | B2 * | 11/2012 | Marois et al. | 2/252 |
| 2002/0078486 | A1 * | 6/2002 | Barnes et al. | 2/84 |
| 2005/0235398 | A1 * | 10/2005 | Yoo | 2/247 |
| 2007/0083984 | A1 | 4/2007 | Wagenknecht et al. | |
| 2008/0196140 | A1 * | 8/2008 | Mayerson et al. | 2/84 |
| 2009/0205096 | A1 | 8/2009 | Seemann | |
| 2011/0185471 | A1 * | 8/2011 | Buczkowski et al. | 2/84 |

* cited by examiner

GARMENT WITH HIDDEN INSULATED BEVERAGE HOLDER

CROSS-REFERENCE TO RELATED APPLICATIONS

This application claims the benefit of U.S. Provisional Application No. 61/363,073 filed Jul. 9, 2010 and is a continuation-in-part of U.S. Design Application No. 29/355,667 filed Feb. 11, 2010, now U.S. Design Pat. No. D627,540.

BACKGROUND

It is known to provide a garment with a beverage holder as disclosed in U.S. Design Pat. Nos. D600,877 and D570,577. Such garments provide the advantage of allowing the wearer to hold onto a beverage container while keeping his/her hands free for other purposes. While the foregoing patented designs may serve their intended purpose, some individuals may prefer a garment having a beverage holder that is hidden or inconspicuous when not in use such that the garment appears to be an ordinary or conventional garment without a beverage holder. Furthermore, the foregoing patented designs do not appear to disclose a beverage holder that is insulated. It is therefore desirable to provide a garment having an insulated beverage holder that is hidden or inconspicuous when not in use.

DESCRIPTION

Figure 1:
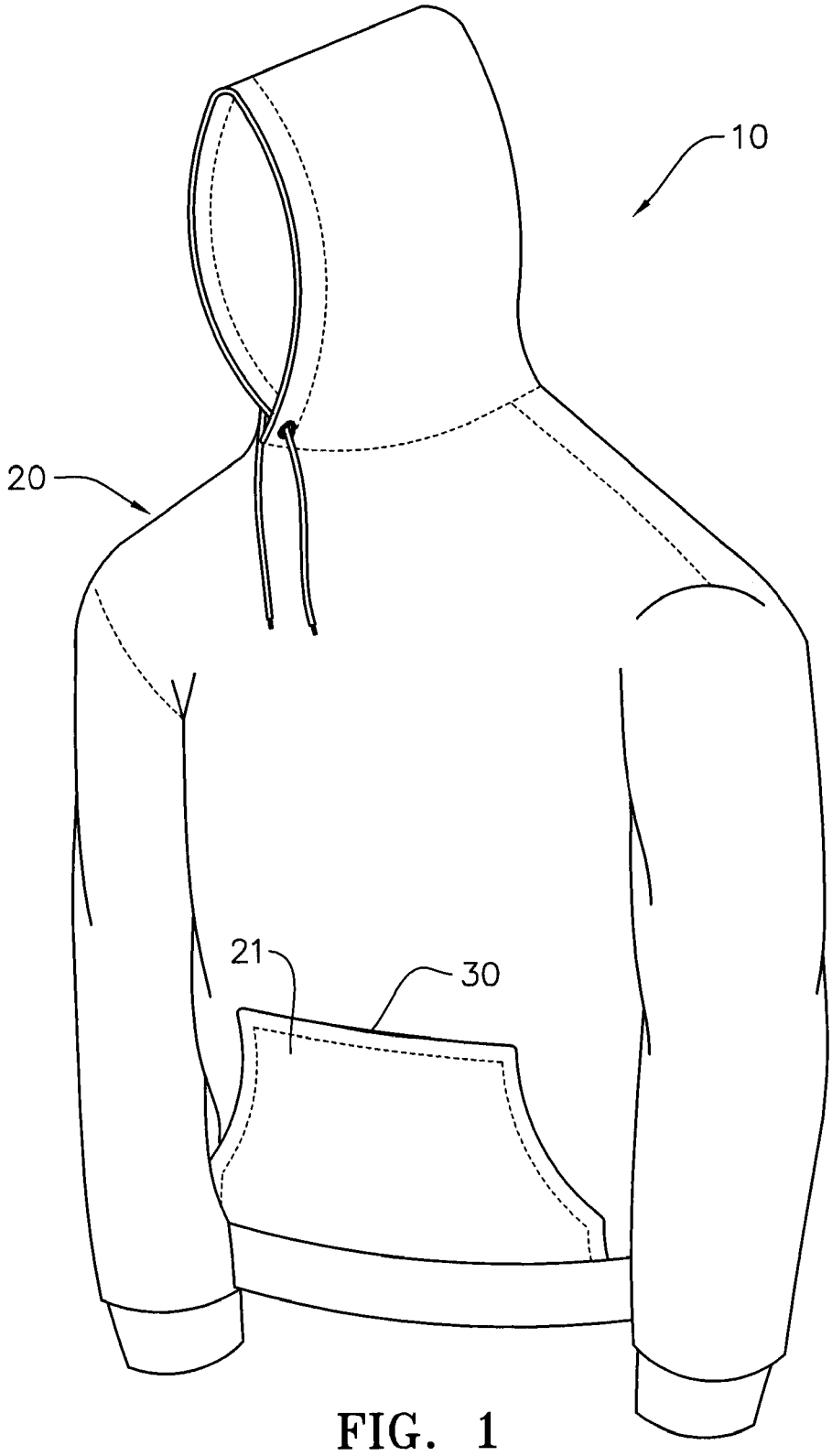
FIG. 1 is a perspective view of an embodiment of one type of garment with a hidden insulated beverage holder in accordance with the present invention.
Figure 2:
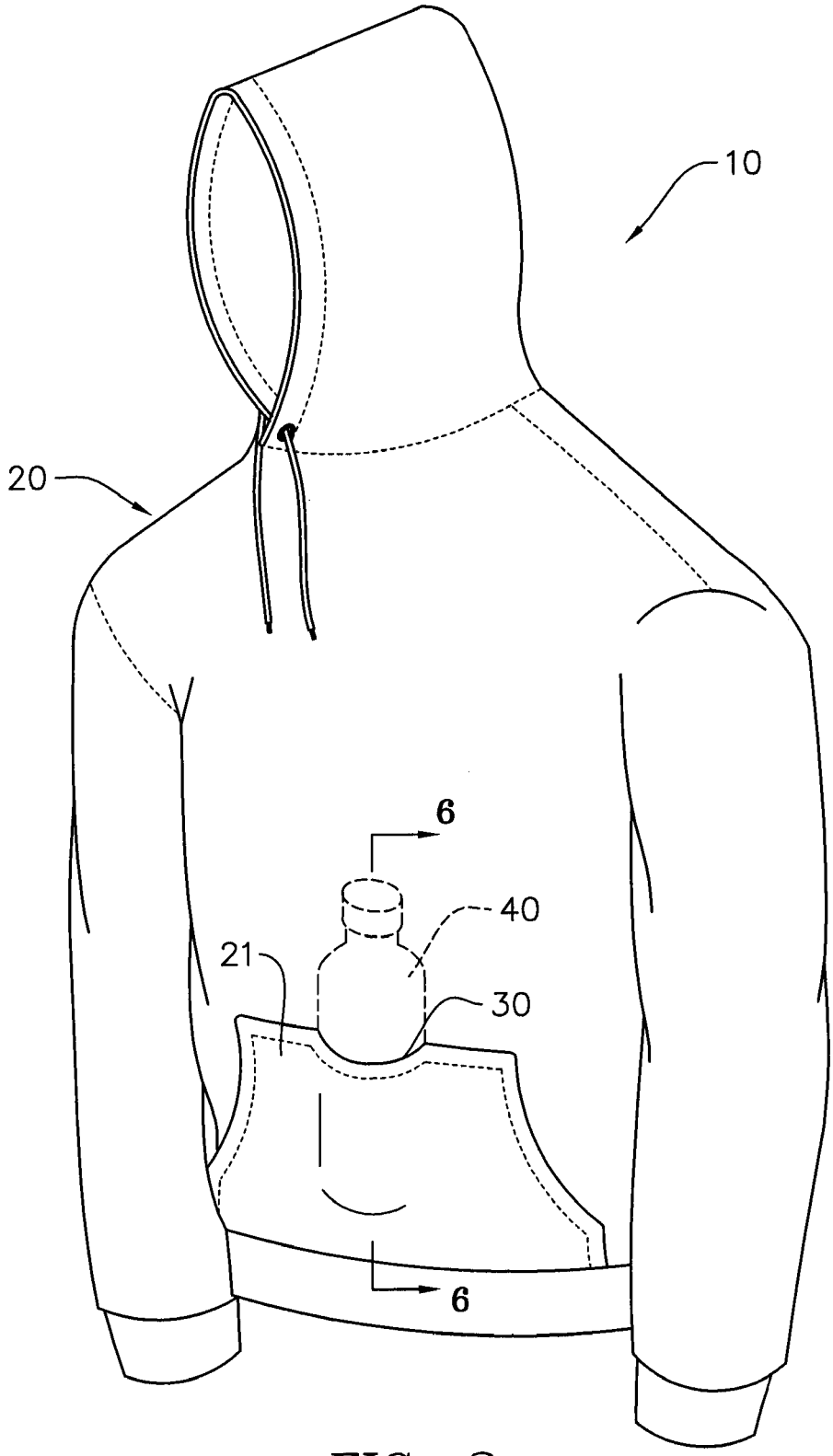
FIG. 2 is the same view as FIG. 1, but with the beverage container received in the hidden insulated beverage holder.

Referring now to the drawings, wherein like reference numerals designate identical or corresponding parts throughout the several views, FIG. 1 illustrates a perspective view of one embodiment of the present invention 10 comprising a garment 20 with hidden insulated beverage holder 30 adapted to receive and hold a beverage container 40 (FIG. 2). Although the garment 20 is depicted as a hooded sweatshirt in FIGS. 1 and 2, it should be appreciated that the garment 20 may be any item of clothing, including, without limitation, sweatshirts, coats, pants, shorts, etc. It is contemplated that the garment 20 will typically be outer-wear apparel made of a material that can more readily hold and support a beverage container without the garment stretching or deforming, and without causing the garment to pull away from the wearer, as one would expect to occur with a T-shirt or other lightweight clothing or under garment material. Nevertheless, the present invention is intended to include within its scope any type of garment, whether outer-wear, an under garment, or other apparel item in which an insulated beverage holder may be disposed anywhere in the garment.

The beverage holder 30 is preferably disposed so as to be concealed or hidden within the garment 20. As best depicted in the hooded sweatshirt embodiment of FIGS. 1-2 and 6-7, the beverage holder 30 is preferably disposed so as to be hidden within the pocket 21 of the sweatshirt such that when a beverage is not in the beverage holder 30, the garment 20 appears to be a conventional or ordinary sweatshirt.

Figure 3A:
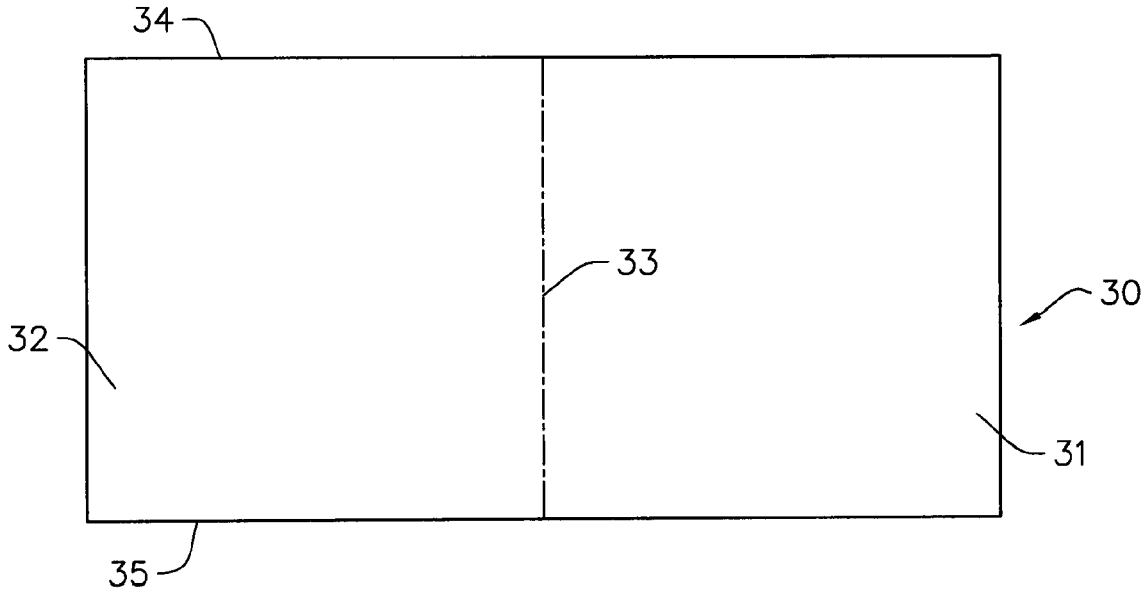
FIG. 3A is a plan view of a pattern for forming an insulated beverage holder for use in a garment.
Figure 4A:
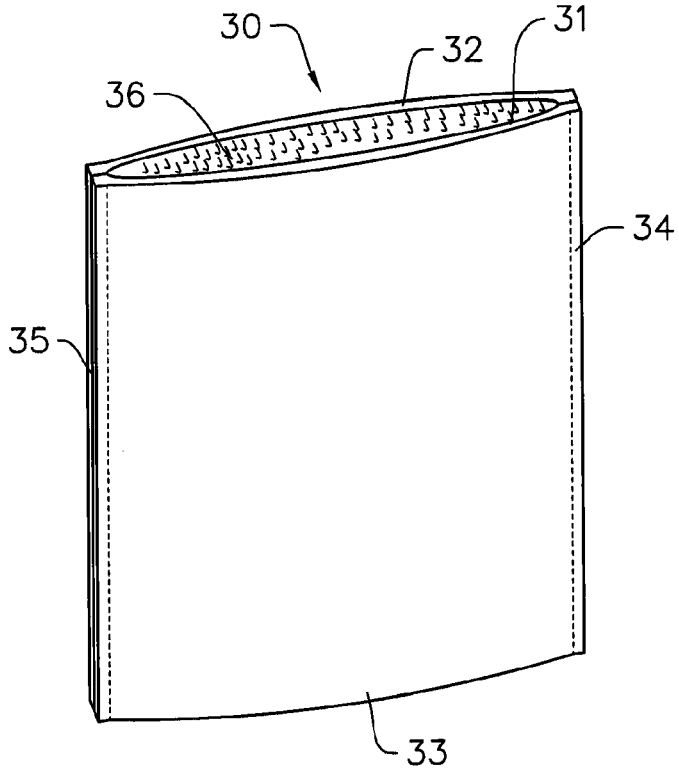
FIG. 4A is a perspective view of the insulated beverage holder formed from the pattern of FIG. 3A.
Figure 3B:
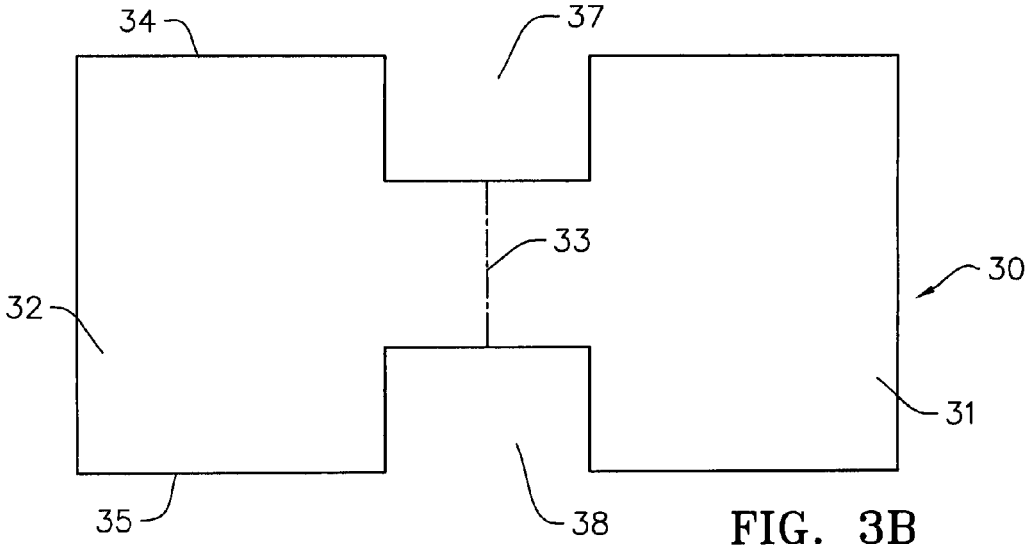
FIG. 3B is a plan view of a pattern with corner cutouts for forming an insulated beverage holder for use in a garment.

As illustrated in FIG. 3A, the beverage holder 30 is preferably comprised of a single piece of material having matching sides 31, 32 which preferably fold together along a crease or fold line 33, which preferably corresponds to a line of symmetry between the two sides 31, 32. The side edges 34, 35 of the holder 30 are preferably secured together by stitches or other suitable connecting means to form a pouch having an open end 36 (FIG. 4A). The side edges 34, 35 may include cutouts 37, 38 (FIGS. 3B and 4B) centered along the fold line 33 which may promote the collapsing of the two sides of the pouch in a substantially flat relation.

In the preferred embodiment, the material for the holder 30 preferably comprises polyurethane foam, approximately ⅛ inch thick, with a polyester brushed fabric backing and a polyester fabric face. It should be appreciated that the insulating foam helps keep the beverage cooler for a longer period of time and holds the beverage container more securely to prevent it from inadvertently falling out of the pouch than if the holder 30 was made of non-insulating material.

It has been determined that a 4¾"×11" piece of material will produce a finished pouch (FIG. 4) that folds substantially flat for concealing in most garments while still holding most standard size beverage containers. When folded and stitched along the mating side edges 34, 35, the finished pouch will have an opening 36 of approximately 4¼ inches wide which is sufficient to receive beverage containers ranging from twelve to twenty-four ounce bottles. Of course, if it is desired to have a larger or smaller holder 30, or if a holder with greater or less insulating properties is desired, modification of the size and/or type of the insulated material and/or the configuration of the pocket can be made as would be readily recognized and understood by those of ordinary skill in the art. The cutouts 37, 38, if desired, may measure 2½"×1½" or any other suitable dimension to promote the holder folding flat so that it is concealed inconspicuously within the garment.

Figure 4B:
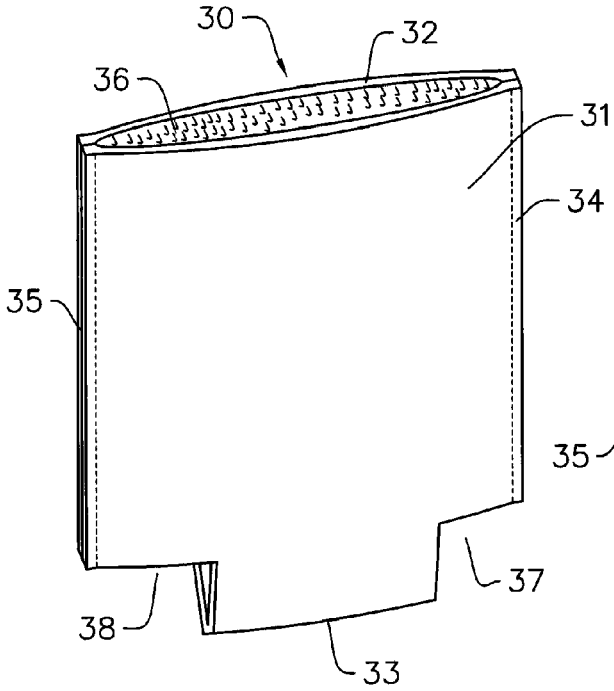
FIG. 4B is a perspective view of the insulated beverage holder formed from the pattern of FIG. 3B.
Figure 5:
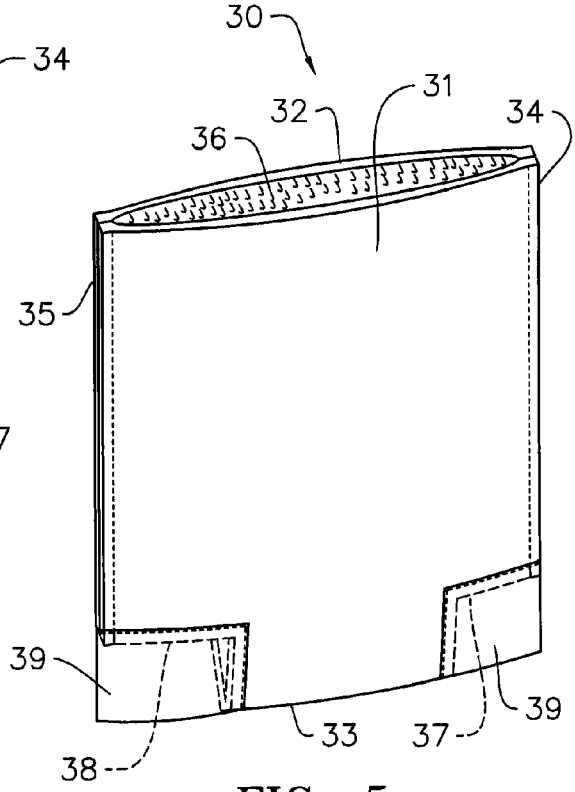
FIG. 5 is a perspective view of the insulated beverage holder of FIG. 4B with the addition of fabric corners.

The holder 30 can serve the dual purpose of holding other smaller items when not holding beverage containers. It should be appreciated that if the holder includes the corner cutouts 37, 38, it may be desirable to close-off the cutouts 37, 38 by stitching or securing polyester or other fabric corners 39 over the cutouts as illustrated in FIG. 5. Of course, if the holder 30 does not include cutouts 37, 38, the additional fabric corners 39 would not be required. Furthermore, as illustrated in FIGS. 4A, 4B and 5, hook and loop fastener strips 42 such as Velcro® or other suitable fastening means, such as zippers, snaps, etc., may be placed near the opening 36 to allow the holder 30 to be closed to prevent items placed therein from inadvertently falling out.

Although the insulated holder 30 is particularly adapted for holding beverage containers, the holder 30 may also be used for holding mp3 players or other electronic devices. A small opening 50 may be provided through the holder 30 and garment 20 for feeding a headphone cord therethrough for the electronic device. Although the opening 50, is preferably on the inside (i.e., body side) of the holder and garment such that the headphone cord is concealed under the garment, the opening 50 may also be provided through outside of the garment or both.

Figure 6:
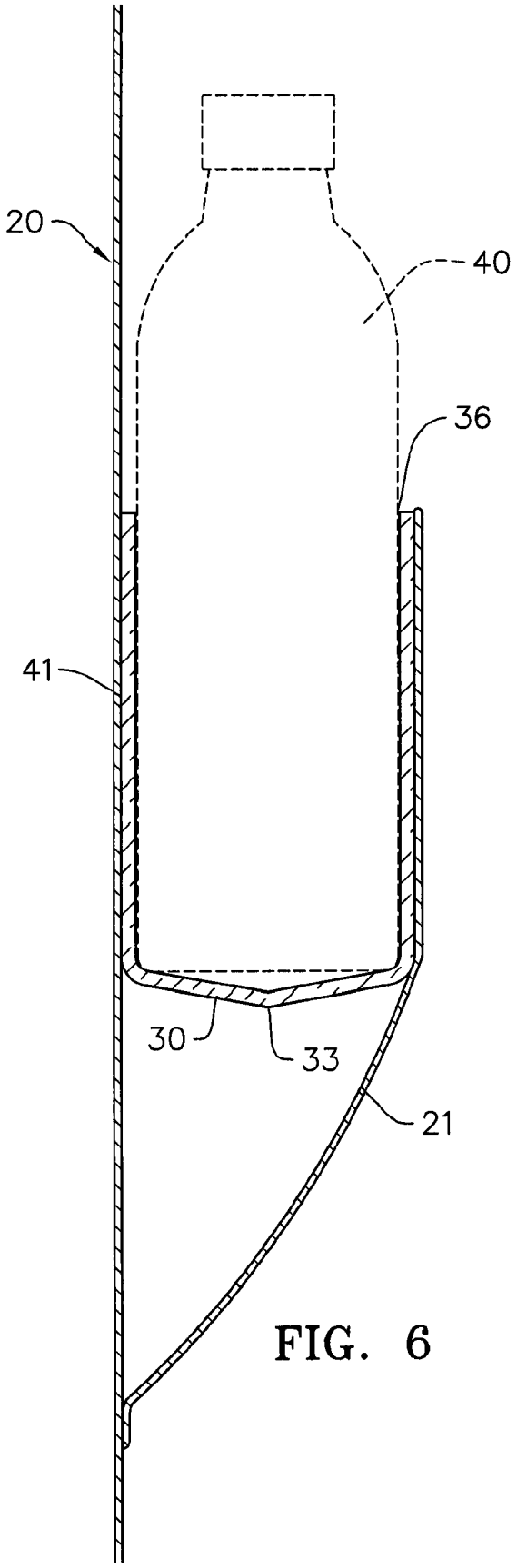
FIG. 6 is an enlarged cross-sectional view of a portion of the garment with hidden insulated beverage holder as viewed along lines 6-6 of FIG. 2.
Figure 7:
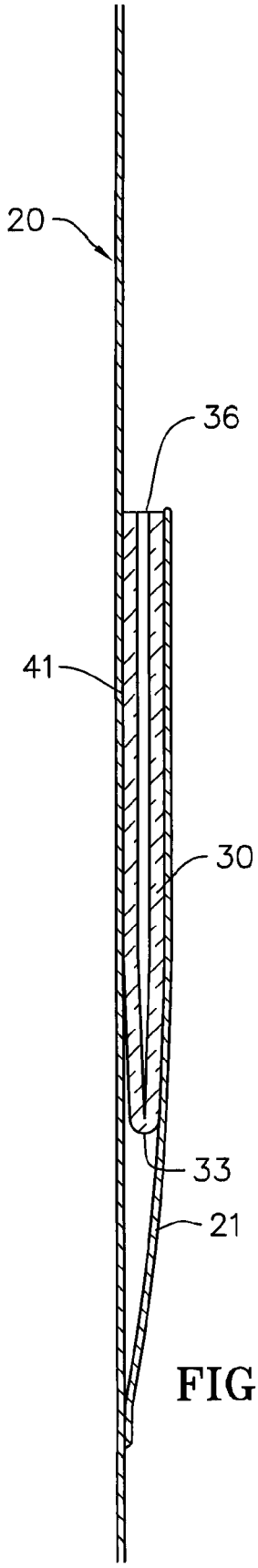
FIG. 7 is the same view as in FIG. 6 with the beverage removed and showing the insulated beverage holder in a collapsed condition.

FIG. 6 illustrates a cross-sectional view of a bottle 40 disposed within the holder 30 of the hooded sweatshirt garment 20 as viewed along lines 6-6 of FIG. 2. FIG. 7 is the same view as FIG. 6, but with the beverage container 40 removed to show how the holder 30 collapses so as to be substantially flat and inconspicuous when not in use.

Figure 8:
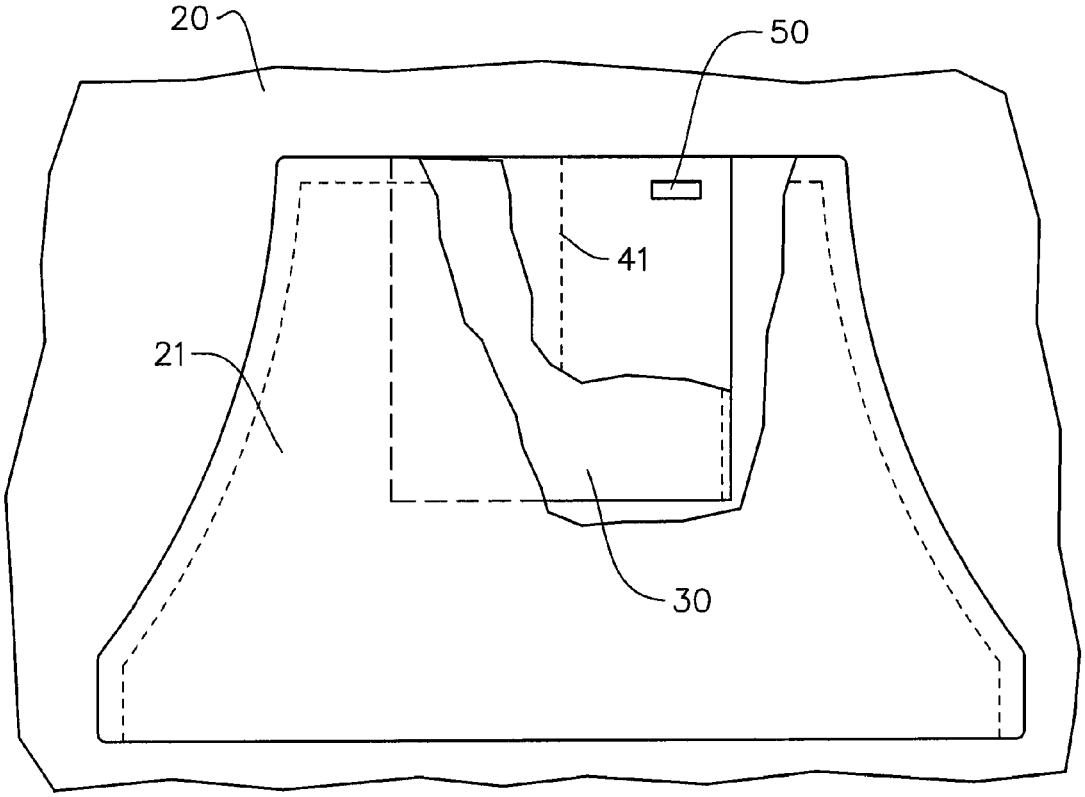
FIG. 8 is a partial cut-away, front elevation view of the garment with hidden insulated beverage holder of FIG. 1.

FIG. 8 is a partial cut-away, front elevation view of the hooded sweatshirt garment 20 showing the beverage holder 30 concealed behind the front pocket 21 of the sweatshirt. To prevent the holder 30 from being pulled up with the beverage container 40 as it is lifted from the garment, the back side 32 of the holder 30 is preferably secured to the garment 20 by a vertical stitch 41. The vertical stitch 41 also helps keep the pouch flat so the holder 30 remains hidden and inconspicuous when not in use.

Figure 9:
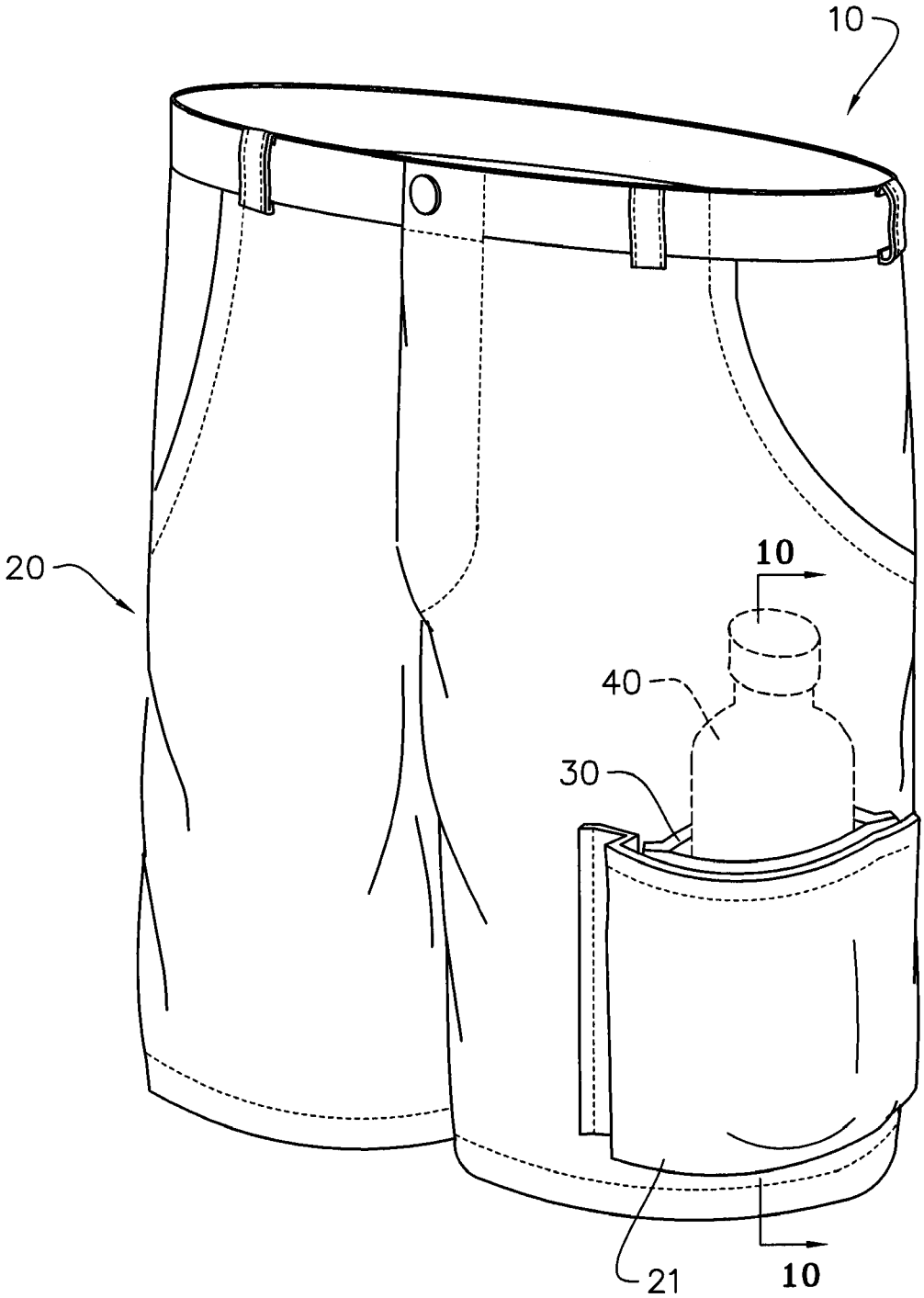
FIG. 9 is a perspective view of an embodiment of another garment with a hidden insulated beverage holder in accordance with the present invention.
Figure 10:
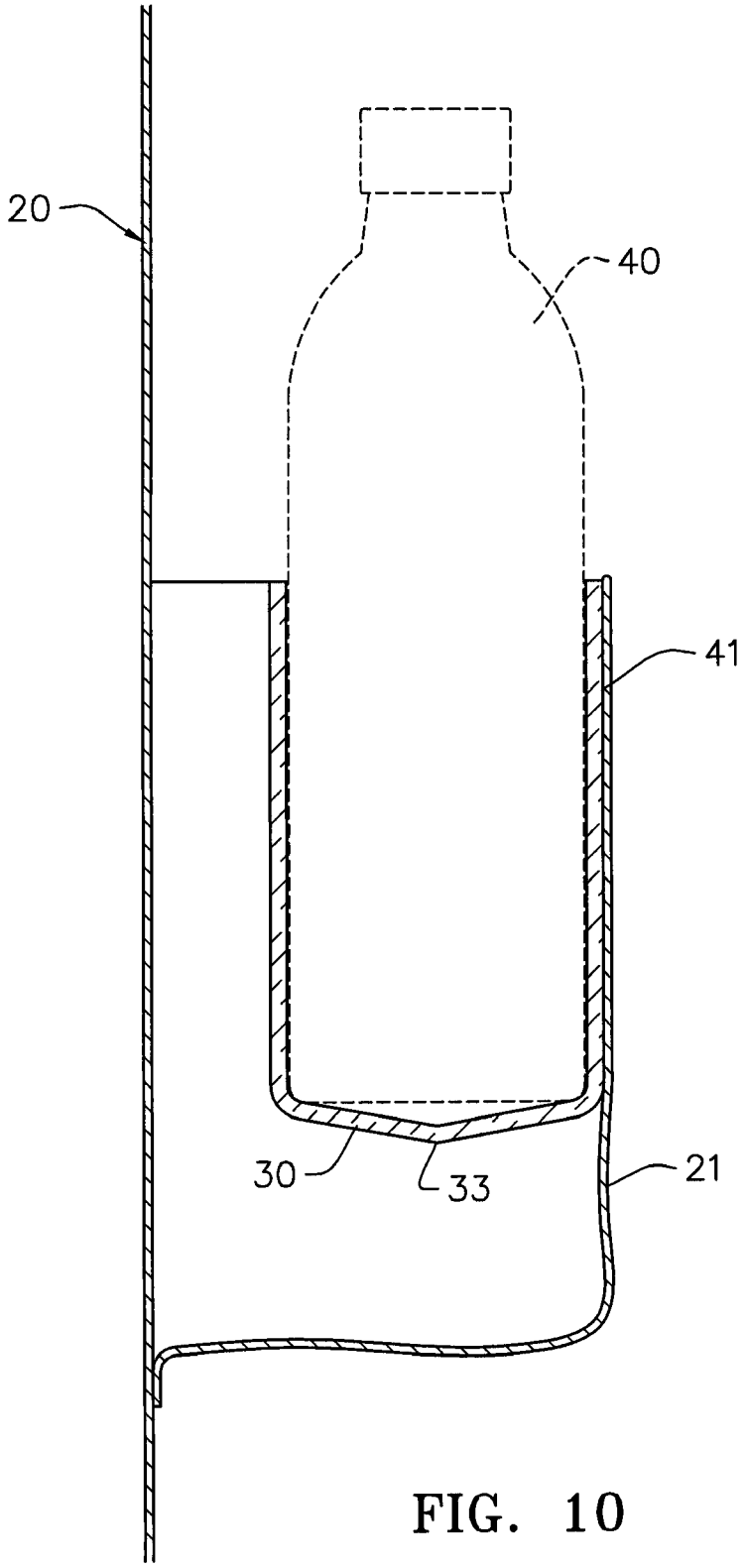
FIG. 10 is an enlarged cross-sectional view of a portion of the garment with hidden insulated beverage holder as viewed along lines 10-10 of FIG. 9.

FIG. 9 illustrates yet another embodiment of another garment 20 with a hidden insulated beverage holder 30 in accordance with the present invention 10. The garment 20 of FIG. 9 is depicted as a pair of shorts in which the beverage holder 30 is concealed within a pocket 21 of the shorts. The holder 30 depicted in the embodiment of FIG. 9 is preferably the same material, size and construction as discussed above. Also, similar to the embodiment of the hooded sweatshirt garment, the holder 30 is preferably secured within the pocket 21 of the shorts 20 by a vertical stitch (41 not visible) to prevent the holder from being pulled up with the beverage container 40 as it is lifted from the garment. The holder 30 is preferably positioned and secured by the vertical stitch 41 within the pocket 21 to allow the pocket 21 to still be used by the wearer for holding other items. Thus, as illustrated in FIG. 10, the wearer can access the pocket 21 behind the holder 30. Alternatively, the holder 30 could be secured to the back of the pocket 21 thereby allowing access to the pocket 21 in front of the holder 30.

The foregoing description is presented to enable one of ordinary skill in the art to make and use the invention. Various modifications to the preferred embodiment, and the general principles and features described herein will be readily apparent to those of skill in the art. Thus, the present invention is not to be limited to the embodiments described above and illustrated in the drawing figures but is to be accorded the broadest scope consistent with the appended claims.

The invention claimed is:

1. A beverage holding garment, comprising:

a garment having a visible outer pocket sized to permit items to be inserted and retained therein and to permit the retained items to be retrieve therefrom;

a beverage holder disposed within the visible outer pocket and substantially concealed by the visible outer pocket, the beverage holder constructed of insulating material forming an interior pouch having an opening sized to receive a beverage container and with insulating sidewalls sufficient to receive a majority of a length of the beverage container, the interior pouch constructed to collapse in substantially flat relation so that the garment appears to not have a beverage holder when the beverage container is not received within the interior pouch; and wherein the interior pouch is constructed of a single piece of insulated material having mating sidewalls which fold together along a fold line and wherein mating edges of the mating sidewalls are secured together to form the interior pouch.

2. A beverage holding garment, comprising:

a garment having a visible outer pocket sized to permit items to be inserted and retained therein and to permit the retained items to be retrieve therefrom;

a beverage holder disposed within the visible outer pocket and substantially concealed by the visible outer pocket, the beverage holder constructed of insulating material forming an interior pouch having an opening sized to receive a beverage container and with insulating sidewalls sufficient to receive a majority of a length of the beverage container, the interior pouch constructed to collapse in substantially flat relation so that the garment appears to not have a beverage holder when the beverage container is not received within the interior pouch;

wherein the interior pouch includes an insulated bottom; and wherein the sidewalls include cutouts centered along the fold line to promote the collapsing of the sidewalls in substantially flat relation when the beverage container is not received within the interior pouch.

* * * * *